US010429780B1

(12) United States Patent
Hasegawa

(10) Patent No.: US 10,429,780 B1
(45) Date of Patent: Oct. 1, 2019

(54) IMAGE FORMING APPARATUS AND METHOD OF CONTROLLING IMAGE FORMING APPARATUS

(71) Applicant: TOSHIBA TEC KABUSHIKI KAISHA, Tokyo (JP)

(72) Inventor: Satoshi Hasegawa, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/199,714

(22) Filed: Nov. 26, 2018

(51) Int. Cl.
*G03G 15/20* (2006.01)

(52) U.S. Cl.
CPC ..... *G03G 15/2039* (2013.01); *G03G 15/2028* (2013.01); *G03G 15/2053* (2013.01)

(58) Field of Classification Search
CPC ..... G03G 15/20; G03G 15/2028; G03G 15/20329; G03G 15/2053; G03G 15/2064; G03G 15/5029; G03G 15/6564; G03G 2215/599; G03G 2215/742; G03G 2215/945; G03G 2215/2074
USPC ..... 399/38, 67–69, 320, 322, 328, 329
See application file for complete search history.

(56) References Cited

U.S. PATENT DOCUMENTS 6,915,099 B2 * 7/2005 Izawa ..... G03G 15/2064 399/328
8,126,387 B2 * 2/2012 Noguchi ..... G03G 15/657 399/167
2015/0286174 A1 10/2015 Yamamoto et al.

* cited by examiner

*Primary Examiner* — Hoan H Tran
(74) *Attorney, Agent, or Firm* — Kim & Stewart LLP

(57) ABSTRACT

An image forming apparatus includes a fixing member and a pressing member forming a fixing nip therebetween, a heat generator, and a processor. The heat generator is disposed to heat a print medium passing through the fixing nip via the fixing member. The processor is configured to control the heat generator to start heating at a timing when a non-fixed image portion formed on the print medium is expected to reach the fixing nip, based on image data of an image to be fixed, a conveyance speed of the print medium, and an estimated heat capacity of the print medium.

20 Claims, 6 Drawing Sheets

IMAGE FORMING APPARATUS AND METHOD OF CONTROLLING IMAGE FORMING APPARATUS

FIELD

Embodiments described herein relate generally to an image forming apparatus and a control method of an image forming apparatus.

BACKGROUND

An image forming apparatus includes an image forming unit which forms a toner image on a print medium, and a fixing device which fixes the toner image to the print medium by applying heat and pressure to the print medium. The fixing device may include a thermal-type fixing device. The fixing device may include a fixing member to move a print medium, a pressing member forming a fixing nip portion, and a heating member including heat generators, which generate heat when currents are supplied thereto and which are arranged in a main scanning direction, and heat the print medium via the fixing member. The fixing device heats the heat generator of the heating member in synchronization with the timing when the print medium with the toner image formed therein passes through the fixing nip portion.

The image forming apparatus may be able to perform printing on various kinds of print media. Depending on various print media, the temperature rising rate may be different even though the quantity of heat provided from the heating member is equal. Therefore, depending on the print medium, it may not be possible to obtain a fixing temperature, which is a temperature sufficient to fix the toner image at timing when the print medium passes through the fixing nip portion.

DETAILED DESCRIPTION

In general, according to an embodiment, an image forming apparatus includes a fixing member and a pressing member forming a fixing nip therebetween, a heat generator, and a processor. The heat generator is disposed to heat a print medium passing through the fixing nip via the fixing member. The processor is configured to control the heat generator to start heating at a timing when a non-fixed image portion formed on the print medium is expected to reach the fixing nip, based on image data of an image to be fixed, a conveyance speed of the print medium, and an estimated heat capacity of the print medium.

Hereinbelow, an image forming apparatus according to an embodiment and a control method of an image forming apparatus will be described with reference to the drawings.

Figure 1:
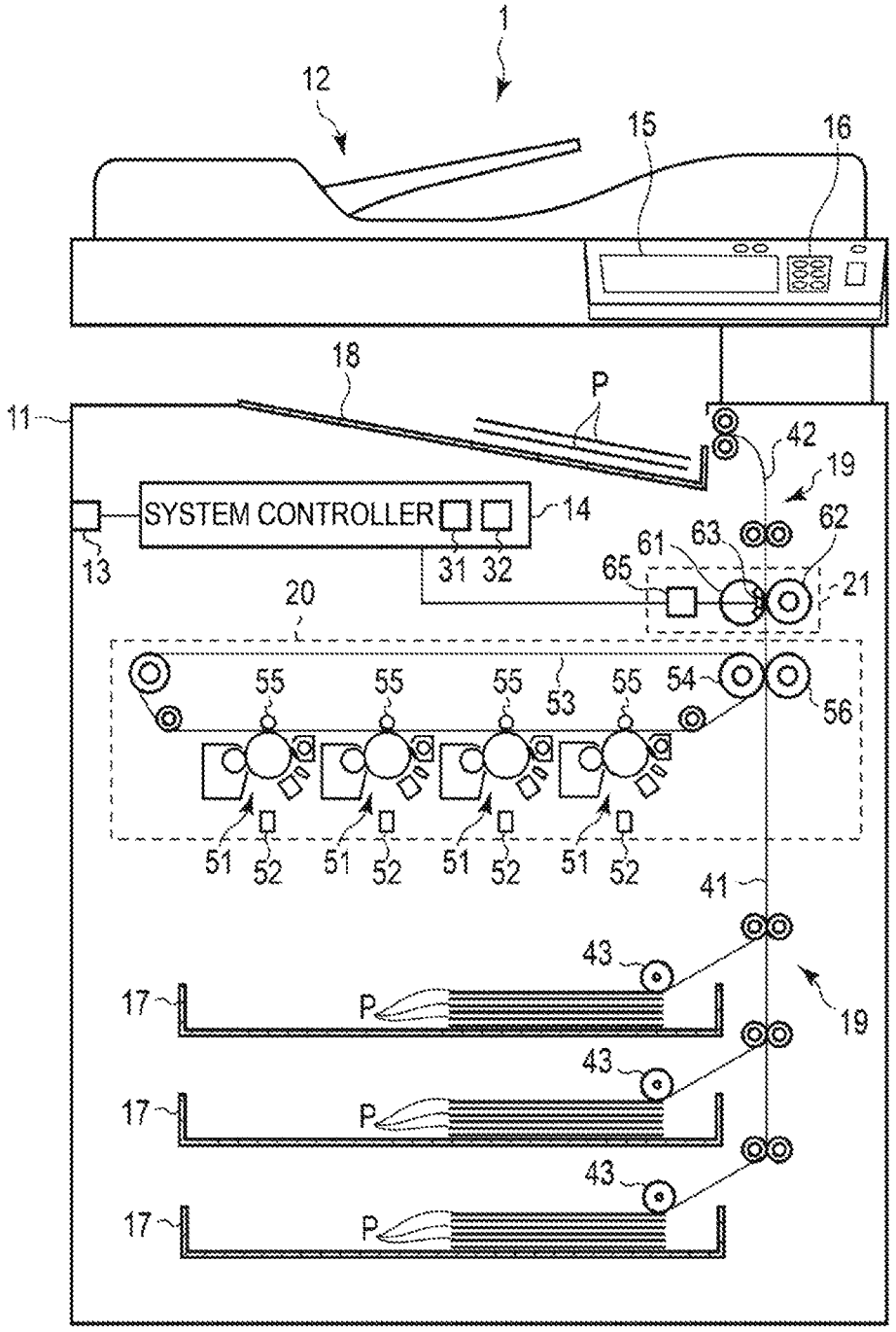
FIG. 1 illustrates an exemplary configuration of an image forming apparatus according to an embodiment.

FIG. 1 is an explanatory diagram for describing an exemplary configuration of an image forming apparatus 1 according to an embodiment.

The image forming apparatus 1 is, for example, a multi-function printer (MFP) which performs various types of processes such as image formation while conveying a medium such as a print medium. The image forming apparatus 1 is, for example, a solid-scanning type printer (for example, an LED printer) which scans an LED array performing various types of processes such as image formation while conveying the medium such as the print medium.

For example, the image forming apparatus 1 has a configuration of forming an image in the print medium using color toner of one or more colors. The color toner includes, for example, Cyan, Magenta, Yellow, and Black toners. The color toner is melt at a temperature equal to or higher than a predetermined fixing temperature, and fixed (solidified) at a temperature equal to or lower than a predetermined temperature. The fixing temperature is, for example, 180° C. Further, the image forming apparatus 1 may have a configuration of forming an image in the print medium in monochrome (for example, black toner).

As illustrated in FIG. 1, the image forming apparatus 1 includes a housing 11, an image reading unit 12, a communication interface 13, a system controller 14, a display unit 15, an operation interface 16, a plurality of paper trays 17, a paper discharge tray 18, a conveyance unit 19, an image forming unit 20, and a fixing device 21.

The housing 11 is a main body of the image forming apparatus 1. The housing 11 accommodates the image reading unit 12, the communication interface 13, the system controller 14, the display unit 15, the operation interface 16, the plurality of paper trays 17, the paper discharge tray 18, the conveyance unit 19, the image forming unit 20, and the fixing device 21.

The image reading unit 12 is configured to read an image from an original document. The image reading unit 12 includes a scanner for example. The scanner acquires an image of the original document according to the control of the system controller 14.

The communication interface 13 is an interface for communication with other devices. The communication interface 13 is used for communication with a host device (external device) for example. The communication interface 13 is formed as a LAN connector for example. In addition, the communication interface 13 may communicate with other devices in a wireless manner according to a standard such as Bluetooth® or Wi-fi®.

The system controller 14 controls the image forming apparatus 1. The system controller 14 includes, for example, a processor 31 and a memory 32. In addition, the system controller 14 is connected to the image reading unit 12, the conveyance unit 19, the image forming unit 20, and the fixing device 21 via a bus.

The processor 31 is an arithmetic module configured to perform a calculation process. The processor 31 is, for example, a CPU. The processor 31 performs various types of processes based on one or more programs stored in the memory 32. The processor 31 serves as a control unit which can perform various types of operations by executing the program stored in the memory 32.

The memory 32 is a recording medium configured to store one or more programs and data to be used in the programs. In addition, the memory 32 also serves as a working memory. In other words, the memory 32 can temporally store data during process of the processor 31, and one or more programs executed by the processor 31.

The processor 31 executes one or more programs stored in the memory 32 to control the image reading unit 12, the conveyance unit 19, the image forming unit 20, and the fixing device 21.

The display unit 15 includes a display configured to display a screen according to a video signal which is input from a display control unit such as the system controller 14 or a graphic controller (not illustrated). For example, a screen for various settings of the image forming apparatus 1 is displayed in the display of the display unit 15.

The operation interface 16 is connected to an operation member (not illustrated). The operation interface 16 supplies an operation signal to the system controller 14 according to an operation using the operation member. The operation member is, for example, a touch sensor, a ten key, a power key, a paper feed key, various types of function keys, or a keyboard. The touch sensor acquires information indicating a position which is designated in a certain area. The touch sensor is formed as a touch panel which is integrated with the display unit 15, and thus inputs a signal indicating a touched position on the screen displayed in the display unit 15 to the system controller 14.

The plurality of paper trays 17 includes cassettes which accommodate a print medium P. The paper tray 17 is configured to supply the print medium P from the outside of the housing 11. For example, the paper tray 17 is provided to be drawn from the housing 11.

The paper discharge tray 18 includes a tray which supports the print medium P discharged from the image forming apparatus 1.

The conveyance unit 19 serves as a mechanism to convey the print medium P in the image forming apparatus 1. As illustrated in FIG. 1, the conveyance unit 19 includes a plurality of conveyance paths. For example, the conveyance unit 19 includes a feeding conveyance path 41 and a discharging conveyance path 42.

The feeding conveyance path 41 and the discharging conveyance path 42 are formed with a plurality of motors, a plurality of rollers, and a plurality of guides, some of which may not be illustrated. The plurality of motors rotate shafts thereof based on the control of the system controller 14 so as to rotate rollers which are linked to the rotation of the shafts. The plurality of rollers convey the print medium P by the rotation. The plurality of guides may control a conveyance direction of the print medium P.

The print medium P from the paper tray 17 is conveyed along the feeding conveyance path 41 to the image forming unit 20. The feeding conveyance path 41 includes a pickup roller 43 corresponding to each paper tray 17. Each pickup roller 43 feeds the print medium P in the corresponding paper tray 17 to the feeding conveyance path 41.

The discharging conveyance path 42 is a conveyance path through which the print medium P with an image formed thereon is discharged from the housing 11. The print medium P discharged by the discharging conveyance path 42 is supported by the paper discharge tray 18.

Next, the image forming unit 20 will be described. The image forming unit 20 is configured to form an image on the print medium P based on the control of the system controller 14. Specifically, the image forming unit 20 forms an image on the print medium P based on a print job generated by the processor 31. The image forming unit 20 includes a plurality of process units 51, a plurality of exposing units 52, a primary transfer belt 53, a secondary transfer opposing roller 54, a plurality of primary transfer rollers 55, and a secondary transfer roller 56.

First, the configuration related to forming an image by the image forming unit 20 will be described. The process unit 51 is configured to form a toner image. For example, the plurality of process units 51 are provided for different toner types. For example, the plurality of process units 51 correspond to the color toners of Cyan, Magenta, Yellow, and Black, respectively. Further, the plurality of process units 51 may have the same configuration except the filled developer, and thus the description will be given on one process unit 51 hereinafter.

The process unit 51 includes a photoconductive drum, an electric charger, and a developing unit.

The photoconductive drum is a photoconductor which includes a cylindrical drum and a photoconductive layer formed on the outer peripheral surface of the drum. The photoconductive drum rotates at a constant speed by being driven by a drive mechanism (not illustrated).

The electric charger evenly charges the surface of the photoconductive drum. For example, the electric charger evenly charges the photoconductive drum with a negative polarity using a charging roller. The charging roller rotates as the photoconductive drum rotates in a state where a predetermined pressure is applied to the photoconductive drum.

The developing unit is a device which applies the toner onto the photoconductive drum. The developing unit includes a developer container, a developing sleeve, and a doctor blade.

The developer container is a container which stores a developer containing toner and carrier. The developer is filled from a toner cartridge. The developing sleeve rotates in the developer container so as to attach the developer to the surface thereof. The doctor blade is a member which is disposed with a predetermined gap with respect to the developing sleeve. The doctor blade adjusts a thickness of the developer which is attached to the surface of the developing sleeve.

Each of the plurality of exposing units 52 is provided to correspond to the photoconductive drum of the corresponding process unit 51. The exposing unit 52 includes a light emitting element such as a laser diode or a light emitting diode (LED). The exposing unit 52 directs a laser beam emitted by the light emitting element to the charged photoconductive drum, and forms an electrostatic latent image on the photoconductive drum.

In the above configuration, when a developer layer formed on the surface of the developing sleeve contacts the surface of the photoconductive drum, the toner on the developer is selectively transferred to the latent image formed on the surface of the photoconductive drum. With this configuration, the toner image is formed on the surface of the photoconductive drum.

Next, the configuration related to the transferring by the image forming unit 20 will be described. The primary transfer belt 53 is an endless belt which is wound on the secondary transfer opposing roller 54 and a plurality of winding rollers. The primary transfer belt 53 is configured such that the inside surface (inner peripheral surface) thereof comes into contact with the secondary transfer opposing roller 54 and the plurality of winding rollers, and the outside surface (outer peripheral surface) faces the photoconductive drum of each of the process units 51.

The secondary transfer opposing roller 54 rotates by being driven by a motor (not illustrated). The secondary transfer opposing roller 54 rotates to move the primary transfer belt 53. The plurality of winding rollers are provided to freely rotate. The plurality of winding rollers rotate in accordance with the movement of the primary transfer belt 53 by the secondary transfer opposing roller 54.

The plurality of primary transfer rollers 55 are configured to cause the primary transfer belt 53 to be in contact with the photoconductive drum of the process unit 51. The plurality of primary transfer rollers 55 are provided to correspond to the plurality of process units 51, respectively. Specifically, the plurality of primary transfer rollers 55 are provided at positions facing the corresponding photoconductive drums of the process units 51, respectively, with the primary transfer belt 53 interposed therebetween. The primary transfer roller 55 comes into contact with the inner peripheral surface of the primary transfer belt 53, and urges the primary transfer belt 53 toward the photoconductive drum. With this configuration, the primary transfer roller 55 causes the outer peripheral surface of the primary transfer belt 53 to be in contact with the corresponding photoconductive drum.

The secondary transfer roller 56 is provided at a position facing the primary transfer belt 53. The secondary transfer roller 56 comes into contact with the outer peripheral surface of the primary transfer belt 53, and applies pressure. With this configuration, a transfer nip portion where the secondary transfer roller 56 and the outer peripheral surface of the primary transfer belt 53 come into tight contact is formed. When the print medium P passes through the transfer nip portion, the secondary transfer roller 56 presses the print medium P passing through the transfer nip portion toward the outer peripheral surface of the primary transfer belt 53.

The secondary transfer roller 56 and the secondary transfer opposing roller 54 rotate to convey the print medium P in a state where the print medium P supplied from the feeding conveyance path 41 is interposed. With this configuration, the print medium P passes through the transfer nip portion.

In the above configuration, when the outer peripheral surface of the primary transfer belt 53 comes into contact with the photoconductive drum, the toner image formed on the surface of the photoconductive drum is transferred to the outer peripheral surface of the primary transfer belt 53. The toner image transferred to the outer peripheral surface of the primary transfer belt 53 is moved by the primary transfer belt 53 up to the transfer nip portion where the secondary transfer roller 56 and the outer peripheral surface of the primary transfer belt 53 are brought into tight contact. If there is a print medium P in the transfer nip portion, the toner image transferred to the outer peripheral surface of the primary transfer belt 53 is transferred to the print medium P at the transfer nip portion. In other words, the toner image of the outer peripheral surface of the primary transfer belt 53 is transferred to the print medium P which passes through the transfer nip portion.

Figure 2:
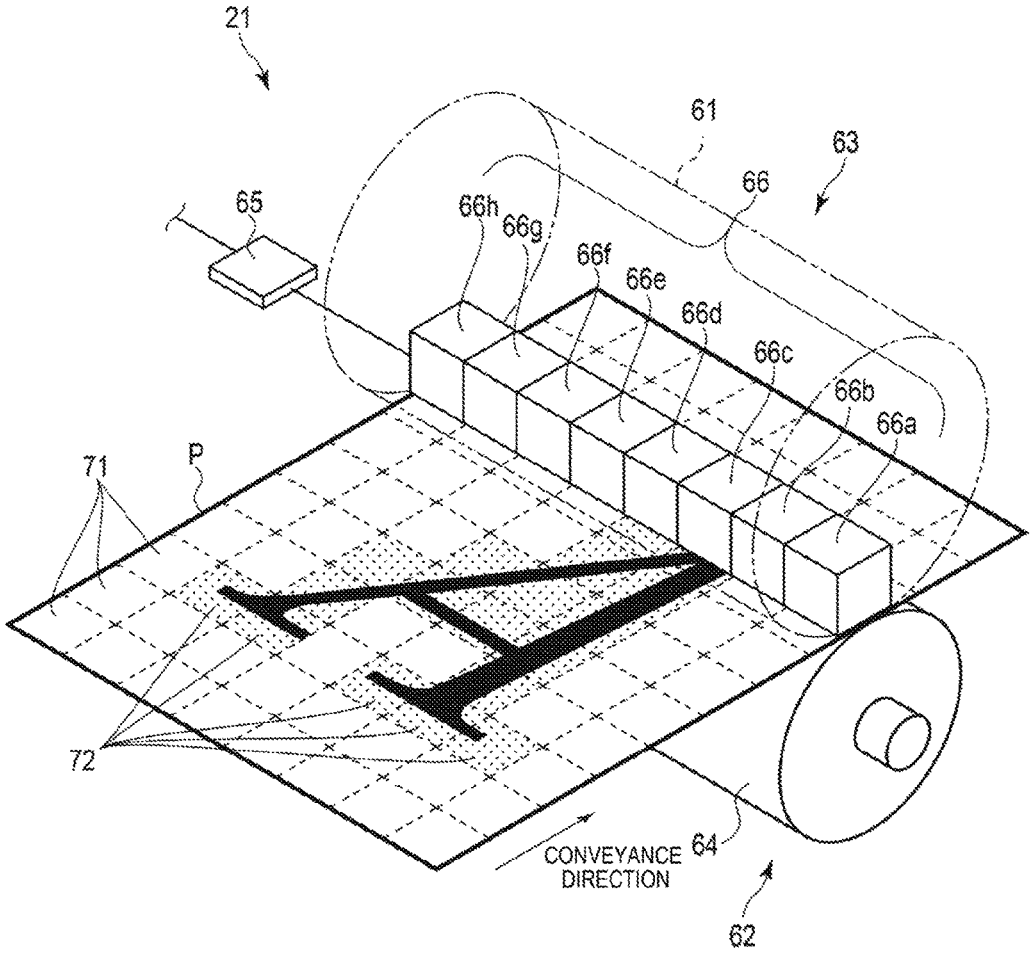
FIG. 2 illustrates an exemplary configuration of a fixing device and surroundings thereof.

Next, the fixing device 21 will be described. FIG. 2 is an explanatory diagram for describing the configuration of the fixing device 21. The fixing device 21 applies heat and pressure to the print medium P with the toner image formed thereon to fix the toner image. The fixing device 21 is a thermal-type fixing device. The fixing device 21 operates based on the control of the system controller 14. The fixing device 21 includes a fixing member 61, a pressing member 62, and a heating member 63.

The fixing member 61 is a fixing rotor to come into contact with the print medium P, and rotate to move the print medium P. The fixing member 61 is formed with a film member which rotates by a drive mechanism (not illustrated) for example. Specifically, the fixing member 61 includes a core member which is formed by a SUS material of 50 μm thickness or by polyimide (a heat resistant resin) of 70 μm thickness, a silicon rubber layer of about 200 μm thickness formed of silicon rubber on the outside of the core member, and a PFA layer of about 50 μm thickness formed of perfluoroalkoxyalkane (PFA) on the outer periphery of the silicon layer.

The pressing member 62 is configured to form a fixing nip portion with the fixing member 61. The pressing member 62 includes a press roller 64 and a pressing mechanism (not illustrated).

The press roller 64 is provided at a position facing the fixing member 61. The press roller 64 rotates by a drive mechanism (not illustrated). The press roller 64 includes a metal core having a predetermined outer diameter, and an elastic layer which is formed on the outer periphery of the core. The press roller 64 is urged toward the fixing member 61 by the pressing mechanism. With this configuration, the press roller 64 comes into tight contact with the surface of the fixing member 61. As a result, the press roller 64 of the pressing member 62 and the fixing member 61 come into tight contact to form the fixing nip portion.

The fixing member 61 and the press roller 64 rotate to move the print medium P in a state where the print medium P passing through the transfer nip portion is interposed. With this configuration, the print medium P passes through the fixing nip portion.

The heating member 63 heats the print medium P passing through the fixing nip portion via the fixing member 61. The heating member 63 is a thermal head which includes a driver IC 65 and the plurality of heat generators 66. The heating member 63 may include a protection layer to prevent the heat generator 66 from being exposed.

The driver IC 65 is a circuit which performs current-applying on each heat generator 66 based on the control of the system controller 14. The driver IC 65 performs current-applying on the heat generator 66 based on timing designated from the system controller 14.

The heat generator 66 is a heating resistor which generates heat when currents are supplied thereto. The heat generator 66 is formed with TaSiO2 for example. The heat generator 66 is formed on a ceramic board. The plurality of heat generators 66 are arranged in a main scanning direction (a direction in parallel to a rotation axis of the press roller 64) in a state where the adjacent heat generators 66 are insulated from each other. In addition, a pair of electrodes (positive electrode and negative electrode) is connected to each heat generator 66. The pair of electrodes of the heat generator 66 are connected to the driver IC 65. The heat generators 66 each generate heat when the current flows from one electrode to the other electrode through the heat generator 66 by the driver IC 65. In other words, the heat generators 66 generate heat individually.

With the above configuration, the heating member 63 applies heat to the print medium P, which passes through the fixing nip portion, via the fixing member 61. With this configuration, the toner image is fixed to the print medium P passed through the fixing nip portion. The print medium P passed through the fixing nip portion is introduced to the discharging conveyance path 42, and discharged to the outside of the housing 11.

Next, the description will be given about the control of the fixing device 21 which is performed by the processor 31 of the system controller 14. The processor 31 controls the heating of the heat generator 66 of the heating member 63 by inputting a control signal to the driver IC 65.

The area on the print medium P to be heated by the heating member 63 is divided in the main scanning direction. The divided areas each are heated by the corresponding heat generators 66. In the example of FIG. 2, the heating member 63 includes eight heat generators 66. The eight heat generators 66 are a heat generator 66*a*, a heat generator 66*b*, a heat generator 66*c*, a heat generator 66*d*, a heat generator 66*e*, a heat generator 66*f*, a heat generator 66*g*, and a heat generator 66*h*. The driver IC 65 individually switches current-application to the heat generator 66*a*, the heat generator 66*b*, the heat generator 66*c*, the heat generator 66*d*, the heat generator 66*e*, the heat generator 66*f*, the heat generator 66*g*, and the heat generator 66*h*. Therefore, the heating member 63 can heat the print medium P individually for each of eight areas arranged in the main scanning direction. In addition, a length in a sub-scanning direction (a direction in parallel to the conveyance direction of the print medium P) of the area on the print medium P to be heated by the heating member 63 is determined by a conveyance speed of the print medium P and a current-application time for the heat generator 66. Further, the current-application time for the heat generator 66 is, for example, determined by clocks input to the driver IC 65. As described above, the area on the print medium P to be heated by the heating member 63 is divided in the main scanning direction and the sub-scanning direction. Further, each individual area obtained by dividing the area on the print medium P in the main scanning direction and the sub-scanning direction is referred to as a division area 71. In addition, each of one or more division areas 71 where the toner image is at least partially formed among the division areas 71 on the print medium P is referred to as an image forming area 72. In other words, the image forming area 72 is the division area 71 on the print medium P which includes the toner image. In FIG. 2, the image forming area 72 is hatched.

The processor 31 can estimate in advance timing when the each division area 71 on a print medium P reaches the fixing nip portion based on conveyance timing of the print medium P and a conveyance speed of the print medium P. In addition, the processor 31 determines whether the toner image is formed in each division area 71 on the print medium P. With this configuration, the processor 31 recognizes the image forming area 72 on the print medium P.

The processor 31 selects the heat generator 66 to which currents are applied by the driver IC 65 based on the position of the image forming area 72 in the main scanning direction. In addition, the processor 31 controls timing at which currents are applied to each heat generator 66 by the driver IC 65 based on timing when the image forming area 72 on the print medium P reaches the fixing nip portion.

In addition, the processor 31 controls timing at which currents are applied to the heat generator 66 based on information on the print medium P used in printing. More specifically, a thermal capacity of the print medium P used in printing is estimated.

In various print media P, a temperature rising rate may be different even though the quantity of heat applied from the heating member 63 is equal. The temperature rising rate varies depending on a thermal capacity (or specific heat) of the print medium P. For example, the print medium P of a smaller thermal capacity leads to a larger temperature rise when the same quantity of heat is applied compared to the print medium P of a larger thermal capacity. The processor 31 estimates the thermal capacity of the print medium P used in printing as a numerical value, and controls the heating of the print medium P by the heating member 63 based on the estimated result.

The thermal capacity varies depending on a basis weight, a ream weight, a thickness, and a material of the print medium P. In other words, the thermal capacity can be estimated based on the basis weight, the ream weight, the thickness, and the material of the print medium P.

For example, in the case of the thermal fixing, the print medium P is instantly heated up to a fixing temperature of the print medium P by the heating member 63. However, depending on the thermal capacity of the print medium P, a too moderate temperature change may occur in the print medium P. In addition, depending on the thermal capacity of the print medium P, the temperature in the print medium P rises too sharply. For this issue, the processor 31 adjusts timing at which currents are applied to each heat generator 66 by the driver IC 65 based on the estimated result of the thermal capacity. Specifically, the processor 31 controls the driver IC 65 to put the current-application timing earlier to apply currents to each heat generator 66 by the driver IC 65 when the thermal capacity of the print medium P is larger than a predetermined threshold (first threshold). In addition, the processor 31 controls the driver IC 65 to apply currents intermittently to each heat generator 66 by the driver IC 65 when the thermal capacity of the print medium P is smaller than a threshold (second threshold) lower than the first threshold.

For example, the processor 31 estimates the thermal capacity of the print medium P used in printing based on information stored in the memory 32. In the memory 32, for example, the paper tray 17 and the information for estimating the thermal capacity of the print medium P are stored in association with each other. For example, the information stored in the memory 32 is information indicating the basis weight, the ream weight, or the thickness of the print medium P which is stored in each paper tray 17.

The basis weight is information indicating a weight per predetermined unit area. The basis weight is, for example, $g/m^2$. The ream weight is information indicating a weight when a predetermined number of print media of a certain dimension are stacked. The ream weight indicates a weight when 1,000 duodecimo print media are stacked for example. The thickness is information simply indicating a thickness of the print medium. There is a strong correlation between the basis weight, the ream weight, and the thickness. In addition, the basis weight, the ream weight, and the thickness of the print medium have a strong correlation with respect to the thermal capacity of the print medium. Therefore, the processor 31 can estimate the thermal capacity of the print medium P based on the basis weight, the ream weight, or the thickness of the print medium P used in printing.

In addition, for example, the information stored in the memory 32 may include information indicating a material of the print medium stored in each paper tray 17. The processor 31 can estimate the thermal capacity of the print medium P based on the basis weight, the ream weight, or the thickness of the print medium P and the material of the print medium P.

Figure 3:
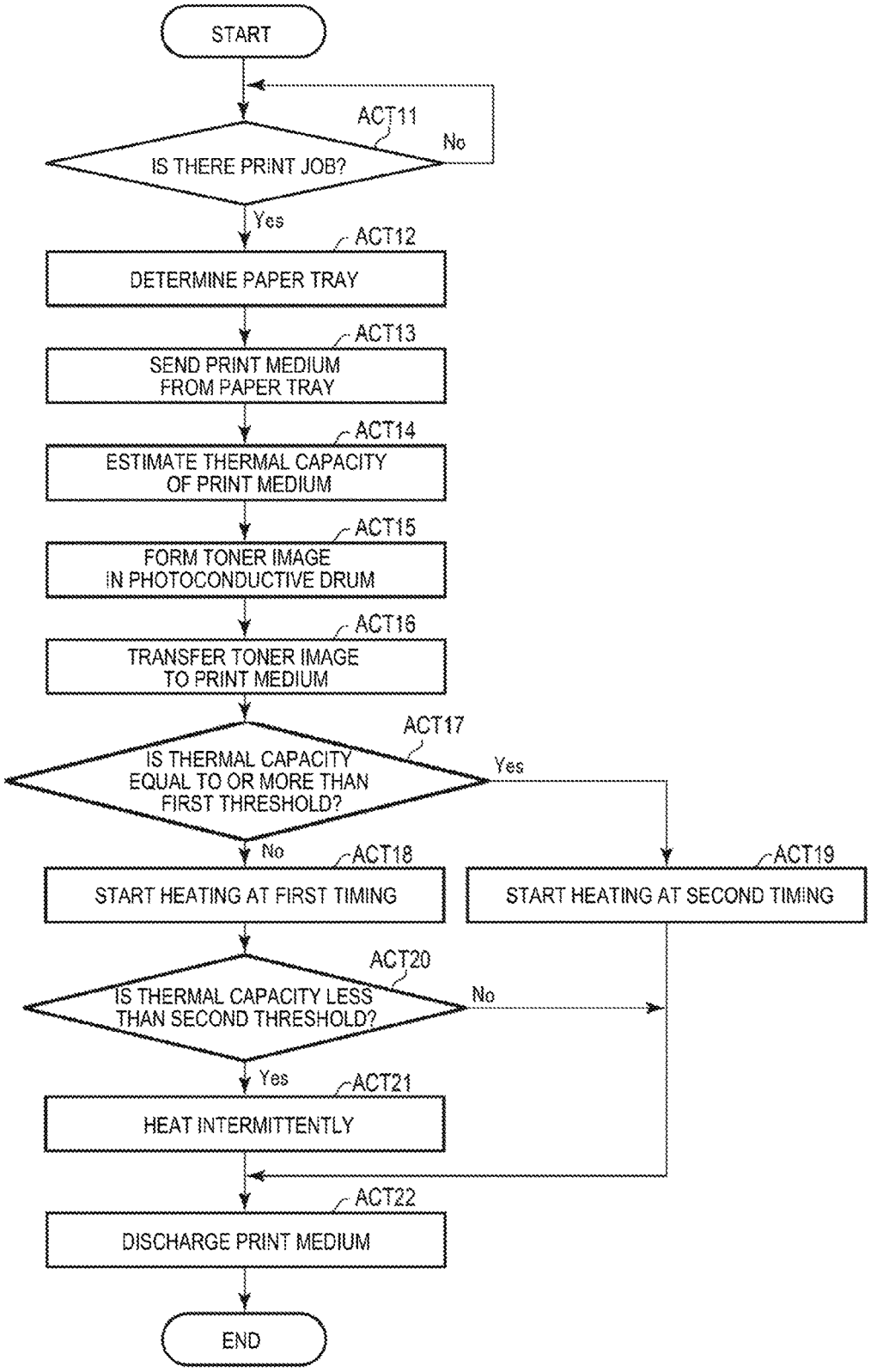
FIG. 3 is a flowchart for describing an exemplary operation of an image forming apparatus according to an embodiment.

Next, the operation of the image forming apparatus 1 will be described. FIG. 3 is a flowchart for describing the operation of the image forming apparatus 1. In the above configuration, the processor 31 of the system controller 14 executes the program stored in the memory 32 to perform a process of generating a print job to form an image in a print medium P. For example, the processor 31 generates a print job based on an image acquired from an external device through the communication interface 13 or an image acquired by the image reading unit 12. The processor 31 stores the generated print job in the memory 32.

The print job includes image data indicating an image to be formed in the print medium P. The image data may be data for forming an image in one print medium P, or may be data for forming an image in a plurality of print media P. Further, the print job may include information indicating the paper tray 17 from which the print medium P is supplied for printing.

The processor 31 determines whether there is a print job when the power of the image forming apparatus 1 is turned on (ACT 11). The processor 31 keeps the determination of ACT 11 until the print job is generated. If it is determined in ACT 11 that there is a print job (ACT 11, YES), the processor 31 determines the paper tray 17 to be used in printing based on the print job (ACT 12). In other words, the processor 31 selects the paper tray 17 which stores a print medium of a type designated by the print job. In addition, the size of the print medium P is designated in the print job, and the processor 31 may select the paper tray 17 based on the size designated by the print job.

The processor 31 controls the conveyance unit 19 to supply the print medium P from the selected paper tray 17 to the feeding conveyance path 41 (ACT 13). With this configuration, the processor 31 causes the print medium P on the selected paper tray 17 to be supplied to the image forming unit 20.

Then, the processor 31 estimates the thermal capacity of the print medium P (ACT 14). In other words, the processor 31 estimates the thermal capacity of the print medium P supplied from the selected paper tray 17 to the feeding conveyance path 41. As described above, the processor 31 acquires the information such as the basis weight, the ream weight, and/or the thickness associated with the selected paper tray 17 from the memory 32. The processor 31 estimates the thermal capacity of the print medium P based on the acquired information such as the basis weight, the ream weight, and/or the thickness.

The processor 31 controls the image forming unit 20 to form a toner image on the photoconductive drum of the process unit 51 based on the print job (ACT 15).

Specifically, the processor 31 rotates the photoconductive drum, turns on the electric charger, and charges the surface of the photoconductive drum evenly. Further, the processor 31 controls the exposing unit 52 to form an electrostatic latent image on the photoconductive drum of the process unit 51. With this configuration, the processor 31 causes the electrostatic latent image corresponding to image data of the print job to be formed on the surface of the photoconductive drum. Further, the processor 31 causes the developing unit to attach the toner to the electrostatic latent image on the photoconductive drum. With this configuration, the processor 31 causes the toner image corresponding to the image data of the print job to be formed on the surface of the photoconductive drum.

The processor 31 controls the image forming unit 20 to transfer the toner image formed on the photoconductive drum to the print medium P (ACT 16). Specifically, the processor 31 rotates the secondary transfer opposing roller 54 and the secondary transfer roller 56 to move the outer peripheral surface of the primary transfer belt 53 in the state of being in contact with the photoconductive drum. If the outer peripheral surface of the primary transfer belt 53 is in contact with the photoconductive drum, the toner image formed on the surface of the photoconductive drum is transferred to the outer peripheral surface of the primary transfer belt 53. The toner image transferred to the outer peripheral surface of the primary transfer belt 53 is moved by the primary transfer belt 53 up to the transfer nip portion where the secondary transfer roller 56 and the outer peripheral surface of the primary transfer belt 53 are brought into tight contact. The processor 31 causes the print medium P to pass through the transfer nip portion in a state where the toner image transferred to the primary transfer belt 53 is in contact with the print medium P supplied from the feeding conveyance path 41. With this configuration, the toner image on the outer peripheral surface of the primary transfer belt 53 is transferred to the print medium P which passes through the transfer nip portion.

The processor 31 determines whether or not the estimated result of the thermal capacity of the print medium P is equal to or more than a first threshold (ACT 17). If the estimated result of the thermal capacity of the print medium P is not equal to or more than the first threshold (ACT 17, NO), the processor 31 starts heating at a first timing (reference timing) (ACT 18), and the process proceeds to ACT 20 described below. The first timing is timing determined based on timing when the image forming area 72 on the print medium P reaches the fixing nip portion. For example, the first timing may be the timing itself when the image forming area 72 on the print medium P reaches the fixing nip portion. In this case, the processor 31 recognizes the image forming area 72 on the print medium P, and controls the driver IC 65 to apply currents to the heat generator 66 corresponding to the position of the main scanning direction of the image forming area 72 at the timing when the image forming area 72 reaches the fixing nip portion.

Figure 4:
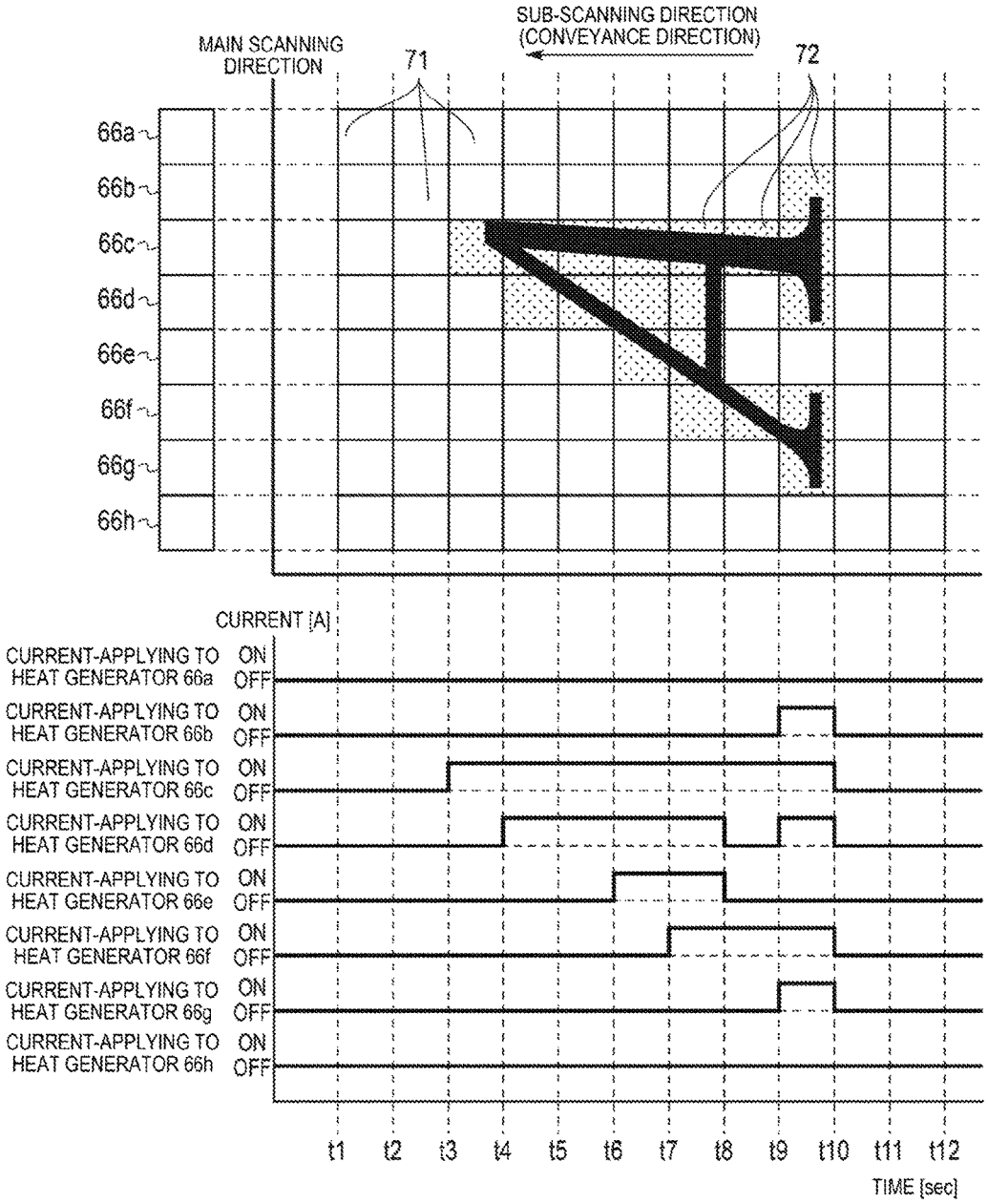
FIGS. 4-6 are each a combination of a schematic diagram depicting a heating map on a print medium and a timing chart for heating the print medium.

FIG. 4 is an explanatory diagram for describing a relation between the timing when the image forming area 72 reaches the fixing nip portion and the timing at which currents are applied to the heat generator 66. FIG. 4 illustrates an example in which the heating starts at timing when the image forming area 72 on the print medium P reaches the fixing nip portion, that is, an example that the heating starts at the first timing. The horizontal axis in FIG. 4 indicates the timing when the respective division areas 71 on the print medium P reach the fixing nip portion. In addition, FIG. 4 illustrates the positions of the heat generators 66 where the respective division areas 71 on the print medium P pass. In addition, FIG. 4 illustrates the timing at which currents are applied to each heat generator 66.

In the example of FIG. 4, the leading end of the print medium P reaches the fixing nip portion at Timing t1, and the trailing end of the print medium P reaches the fixing nip portion at Timing t12. In addition, the image forming area 72 reaches a position corresponding to the heat generator 66*c* of the fixing nip portion at Timing t3. The processor 31 controls the driver IC 65 to start applying current to the heat generator 66*c* at Timing t3.

Next, the image forming area 72 reaches a position corresponding to the heat generator 66*d* of the fixing nip portion at Timing t4. The processor 31 controls the driver IC 65 to start applying current to the heat generator 66*d* at Timing t4. Similarly, the processor 31 controls the driver IC 65 to start applying current to the heat generator 66*e* at Timing t6, and to the heat generator 66*f* at Timing t7.

The image forming area 72 passes a position corresponding to the heat generator 66*d* and the heat generator 66*e* of the fixing nip portion at Timing t8. The processor 31 controls the driver IC 65 to end applying current to the heat generator 66*d* and the heat generator 66*e* at Timing t8. In this way, the processor 31 controls the current-application to the heat generator 66 by the driver IC 65 based on a positional relation of the image forming area 72 with respect to the fixing nip portion.

If it is determined in ACT 17 of FIG. 3 that the estimated result of the thermal capacity of the print medium P is equal to or more than the first threshold (ACT 17, YES), the processor 31 starts the heating at a second timing (timing earlier than the reference) (ACT 19), and the process proceeds to ACT 22 described below. The second timing is timing determined based on the timing when the image forming area 72 on the print medium P reaches the fixing nip portion, and is earlier than the first timing. For example, the second timing is timing when the division area 71 close to the fixing nip portion from the image forming area 72 on the print medium P reaches the fixing nip portion. More specifically, the second timing is timing when an expanded image forming area 73 which is the division area 71 close to one fixing nip portion from the image forming area 72 on the print medium P reaches the fixing nip portion.

Figure 5:
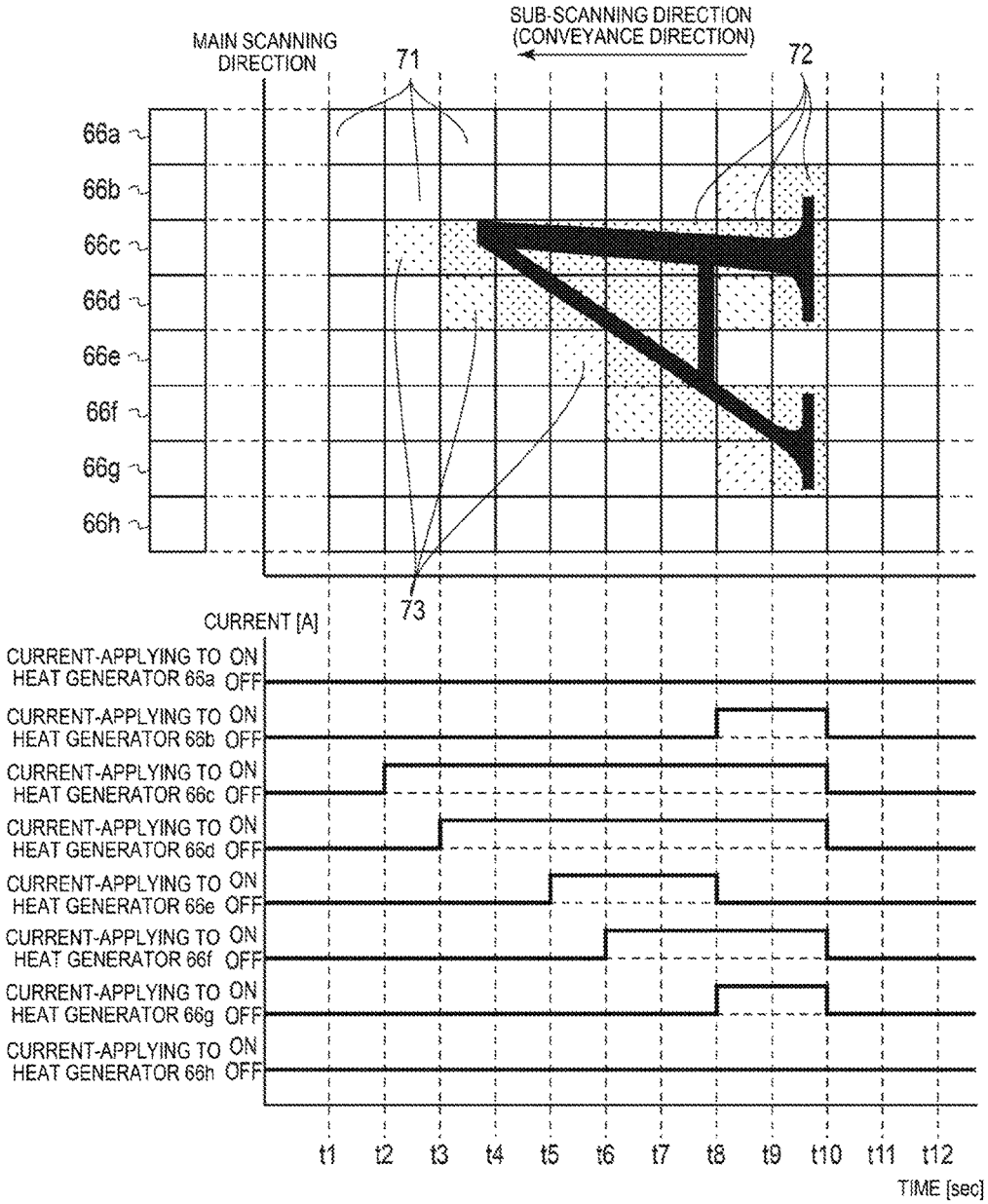

FIG. 5 is an explanatory diagram for describing a relation between the timing when the image forming area 72 reaches the fixing nip portion and the timing at which currents are applied to the heat generator 66. FIG. 5 illustrates an example in which the heating starts at timing when the expanded image forming area 73 on the print medium P reaches the fixing nip portion, that is, an example in which the heating starts at the second timing. The horizontal axis in FIG. 5 indicates the timing when the respective division areas 71 on the print medium P reaches the fixing nip portion. In addition, FIG. 5 illustrates the positions of the heat generators 66 where the respective division areas 71 on the print medium P pass. In addition, FIG. 5 illustrates the timing at which currents are applied to each heat generator 66.

In the example of FIG. 5, the leading end of the print medium P reaches the fixing nip portion at Timing t1, and the trailing end of the print medium P reaches the fixing nip portion at Timing t12. In addition, the expanded image forming area 73 reaches a position corresponding to the heat generator 66*c* of the fixing nip portion at Timing t2. In this case, the processor 31 controls the driver IC 65 to start applying current to the heat generator 66*c* at Timing t2.

At Timing t3, the expanded image forming area 73 reaches a position corresponding to the heat generator 66*d* of the fixing nip portion. The processor 31 controls the driver IC 65 to start applying current to the heat generator 66*d* at Timing t3. Similarly, the processor 31 controls the driver IC 65 to start applying current to the heat generator 66*e* at Timing t5, and to the heat generator 66*f* at Timing t6. In this way, the processor 31 controls the current-application to the heat generator 66 by the driver IC 65 based on a positional relation of the expanded image forming area 73 and the image forming area 72 with respect to the fixing nip portion. With this configuration, heat is sufficiently applied to the image forming area 72 of the print medium P by the heating member 63.

In addition, when the heating at the first timing starts in ACT 18 of FIG. 3, the processor 31 determines whether or not the estimated result of the thermal capacity of the print medium P is less than the second threshold lower than the first threshold (ACT 20). If it is determined that the estimated result of the thermal capacity of the print medium P is equal to or more than the second threshold (ACT 20, NO), the process proceeds to ACT 22 described below.

If it is determined that the estimated result of the thermal capacity of the print medium P is less than the second threshold (ACT 20, YES), the processor 31 controls the driver IC 65 to apply currents intermittently to the heat generator 66 (ACT 21). In other words, if the estimated thermal capacity is less than the first threshold and equal to or more than the second threshold lower than the first threshold, the processor 31 performs current-application on the heat generator 66 by a first length. In addition, if the estimated thermal capacity is less than the second threshold, the processor 31 performs current-application on the heat generator 66 by a second length shorter than the first length. With this configuration, a total time of applying heat to the image forming area 72 on the print medium P is controlled to be shortened. As a result, the temperature of the print medium P is controlled not to be increased too much. Further, an area which is the image forming area 72 on the print medium P and in which currents are intermittently applied to the heat generator 66 is referred to as an intermittently controlled area 74.

Figure 6:
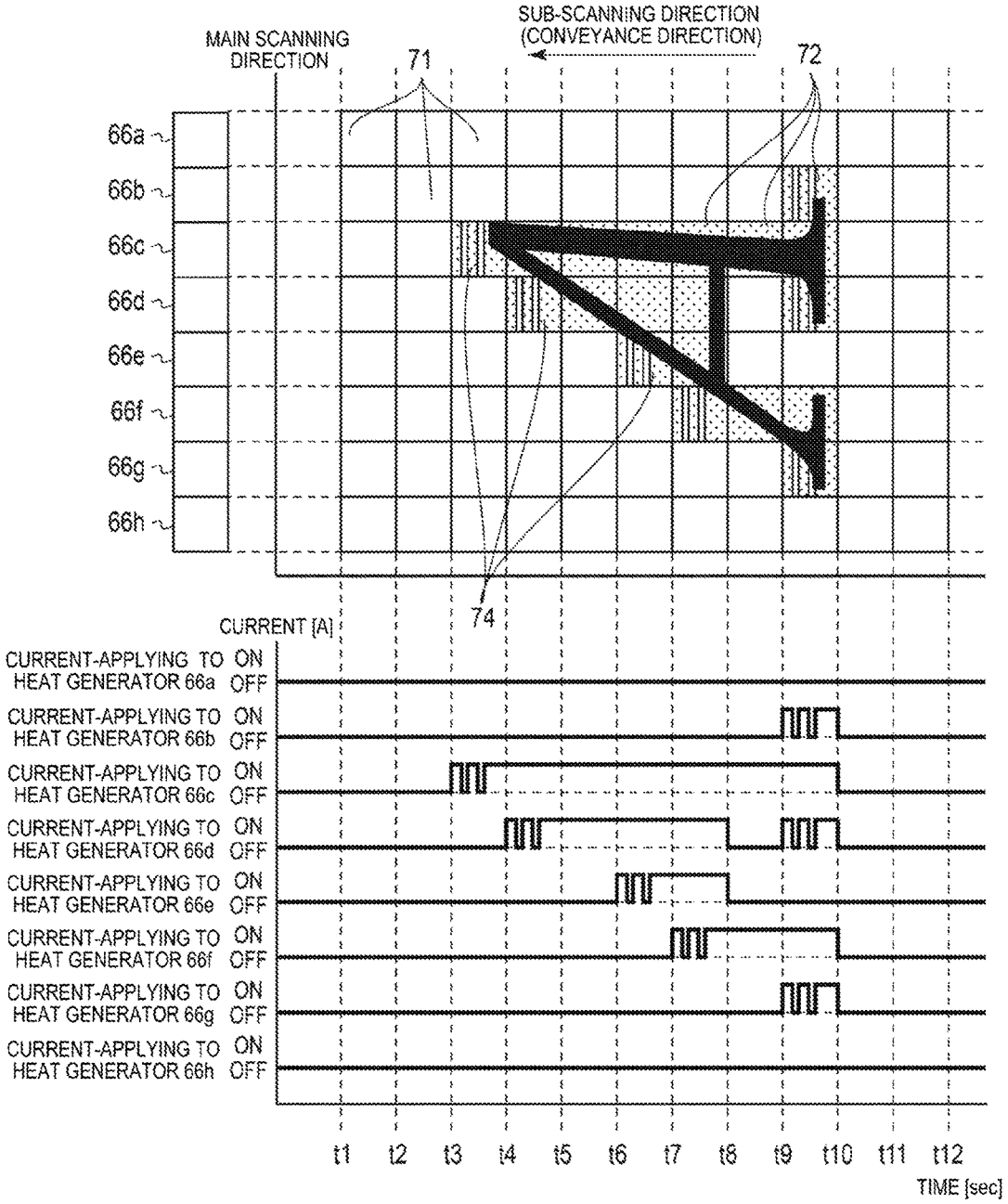

FIG. 6 is an explanatory diagram for describing a relation between the timing when the image forming area 72 reaches the fixing nip portion and the timing at which currents are applied to the heat generator 66. FIG. 6 illustrates an example in which currents are intermittently applied to the heat generator 66 during the intermittently controlled area 74 on the print medium P passes through the fixing nip portion. The horizontal axis in FIG. 6 illustrates the timing when the respective division areas 71 on the print medium P reaches the fixing nip portion. In FIG. 6, there are illustrated positions of the heat generator 66 where the respective division areas 71 on the print medium P passes through. In addition, in FIG. 6, there is illustrated timing at which currents are applied to each heat generator 66.

In the example of FIG. 6, the leading end of the print medium P reaches the fixing nip portion at Timing t1, the trailing end of the print medium P reaches the fixing nip portion at Timing t12. In addition, the intermittently controlled area 74 reaches a position corresponding to the heat generator 66*c* of the fixing nip portion at Timing t3. In this case, the processor 31 controls the driver IC 65 to apply currents intermittently to the heat generator 66*c* from Timing t3.

The intermittently controlled area 74 reaches a position corresponding to the heat generator 66*d* of the fixing nip portion at Timing t4. The processor 31 controls the driver IC 65 to apply currents intermittently to the heat generator 66*d* at Timing t4. Similarly, the processor 31 starts the intermittent current-application on the heat generator 66*e* at Timing t6, and controls the driver IC 65 start the intermittent current-application on the heat generator 66*f* at Timing t7. The processor 31 returns to a normal current-application on the heat generator 66 when the intermittently controlled area 74 passes through the fixing nip portion. In other words, the driver IC 65 is controlled such that a predetermined current flows continuously to the heat generator 66 instead of the intermittent current-application. With this configuration, the heat is appropriately applied to the image forming area 72 of the print medium P by the heating member 63.

Further, the intermittently controlled area 74 is not limited to the above example. For example, the processor 31 may intermittently apply currents to the heat generator 66 by setting the entire area of the image forming area 72 as the intermittently controlled area 74. With this configuration, the heat is appropriately applied to the image forming area 72 of the print medium P by the heat member 63 even if the thermal capacity is extremely low, or the temperature of the heat generator 66 is high.

With the above process, the heat for fixing the toner is applied to the image forming area 72 with the toner image on the print medium P. As a result, the toner image can be fixed to the print medium P. The print medium P passing through the fixing nip portion is supplied to the discharging conveyance path 42.

The processor 31 controls the conveyance unit 19 to discharge the print medium P supplied to the discharging conveyance path 42 to the paper discharge tray 18 (ACT 22), and ends the process. With this configuration, the print medium P with the toner image formed thereon is stacked in the paper discharge tray 18.

As described above, the image forming apparatus 1 includes the fixing member 61, the pressing member 62, the heating member 63, and the processor 31. The fixing member 61 is configured to contact the print medium P having the image forming area 72 with the toner image formed therein, and rotate to move the print medium P. The pressing member 62 is configured to tightly contact the fixing member 61, and form the fixing nip. The heating member 63 includes the heat generator 66, which generates heat when currents are applied thereto, and heats the print medium P passing through the fixing nip via the fixing member 61. The processor 31 controls the heat generator to start heating at a timing when a non-fixed image portion formed on the print medium P is expected to reach the fixing nip portion, based on image data of an image to be fixed, a conveyance speed of the print medium P, and an estimated heat capacity of the print medium P. In particular, the processor 31 estimates the thermal capacity of the print medium P, and switches, based on the estimated result of the thermal capacity, the timing at which current-application to the heat generator 66 is started between the first timing corresponding to the timing when the image forming area 72 on the print medium P reaches the fixing nip portion and the second timing earlier than the first timing. With this configuration, the image forming apparatus 1 can adjust the timing of heating the print medium P according to the thermal capacity of the print medium P. As a result, the image forming apparatus 1 can apply an appropriate quantity of heat to the print medium P when the image forming area 72 on the print medium P passes through the fixing nip portion.

In addition, for example, if the estimated thermal capacity is less than the predetermined first threshold, the processor 31 starts to perform current-application on the heat generator 66 at the first timing. If the estimated thermal capacity is equal to or more than the predetermined first threshold, the processor 31 starts to perform current-application on the heat generator 66 at the second timing. With this configuration, the image forming apparatus 1 can start heating the print medium P of which thermal capacity is larger than the reference at timing earlier than the reference. As a result, the image forming apparatus 1 can apply a sufficient quantity of heat to the print medium P of which the thermal capacity is larger than the reference.

In addition, for example, when the estimated thermal capacity is less than the first threshold and equal to or more than the second threshold lower than the first threshold, the processor 31 performs current-application on the heat generator 66 by the first length. When the estimated thermal capacity is less than the second threshold, the processor 31 performs current-application on the heat generator 66 by second length shorter than the first length. Specifically, when the estimated thermal capacity is less than the second threshold, the processor 31 performs current-application intermittently on the heat generator 66 to control the heat quantity to be applied to the print medium P. With this configuration, the image forming apparatus 1 can apply an appropriate quantity of heat to the print medium P of which the thermal capacity is smaller than the reference.

The processor 31 estimates the thermal capacity based on the basis weight, the ream weight, and/or the thickness of the print medium P. Specifically, the processor 31 estimates the thermal capacity based on the basis weight, the ream weight, and/or the thickness of the print medium P which is set for each paper tray 17. In addition, the processor 31 estimates the thermal capacity based on the material of the print medium P. Specifically, the processor 31 estimates the thermal capacity based on the material of the print medium P which is set to each paper tray 17.

Further, the image forming apparatus 1 may further include a thickness sensor which detects a thickness of the print medium P supplied from the paper tray 17 to the feeding conveyance path 41. With this configuration, the processor 31 can estimate the thermal capacity of the print medium P based on the detection result of the thickness of the print medium P supplied from the paper tray 17 to the feeding conveyance path 41. With such a configuration, even if the basis weight, the ream weight, and/or the thickness is not set for each paper tray 17, the processor 31 can control the timing at which currents are applied to the heat generator 66 based on the estimated result of the thermal capacity of the print medium P.

Further, the functions described in the above embodiments are not limited to hardware configurations, may be realized by a computer-readable software program having the functions. In addition, the functions may be configured by appropriately selecting any one of the software and hardware configurations.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

a fixing member and a pressing member forming a fixing nip therebetween;

a heat generator disposed to heat a print medium passing through the fixing nip via the fixing member; and a processor configured to control the heat generator to start heating at a timing when a non-fixed image portion formed on the print medium is expected to reach the fixing nip, based on image data of an image to be fixed, a conveyance speed of the print medium, and an estimated heat capacity of the print medium.

2. The image forming apparatus according to claim 1, wherein the heat generator is individually controllable with respect to a plurality of regions thereof in a main scanning direction, and the processor is configured to control the heat generator, such that a timing for one of the regions of the heat generator corresponding to a leading end of the non-fixed image in a sub scanning direction to start operating corresponds to a timing for the leading end of the non-fixed image to reach the fixing nip.

3. The image forming apparatus according to claim 1, wherein the processor controls the heat generator to start heating at a first timing when the print medium is estimated to have a first heat capacity, and at a second timing earlier than the first timing when the print medium is estimated to have a second heat capacity that is greater than the first heat capacity.

4. The image forming apparatus according to claim 1, wherein the processor estimates heat capacity based on at least one of a basis weight, a ream weight, and a thickness of the print medium.

5. The image forming apparatus according to claim 1, wherein the processor estimates heat capacity based on a material of the print medium.

6. The image forming apparatus according to claim 1, wherein the processor controls the heat generator to start heating at a first timing when the estimated heat capacity is smaller than a first threshold, and at a second timing earlier than the first timing when the estimated heat capacity is greater than the first threshold.

7. The image forming apparatus according to claim 1, wherein the processor is further configured to control current applied to the heat generator according to a current application pattern that is set based on the estimated heat capacity.

8. The image forming apparatus according to claim 7, wherein the processor sets the current application pattern to a first current application pattern of continuously applying current to the heat generator when the print medium is estimated to have a first heat capacity, and to a second current application pattern of intermittently applying current to the heat generator when the print medium is estimated to have a second heat capacity that is smaller than the first heat capacity.

9. The image forming apparatus according to claim 7, wherein the processor sets the current application pattern to a first current application pattern of applying current to the heat generator for a first period of time when the print medium is estimated to have a first heat capacity, and to a second current application pattern of applying current to the heat generator for a second period of time shorter than the first period of time when the print medium is estimated to have a second heat capacity that is smaller than the first heat capacity.

10. An image forming apparatus comprising:

a fixing member and a pressing member forming a fixing nip therebetween;

a heat generator disposed to heat a print medium passing through the fixing nip via the fixing member; and a processor configured to control the heat generator to start heating at a timing when a non-fixed image portion formed on the print medium is expected to reach the fixing nip, based on image data of an image to be fixed, a conveyance speed of the print medium, and control current applied to the heat generator according to a current application pattern that is set based on an estimated heat capacity of the print medium.

11. The image forming apparatus according to claim 10, wherein the heat generator is individually controllable with respect to a plurality of regions thereof in a main scanning direction, and the processor is configured to control the heat generator, such that a timing for one of the regions of the heat generator corresponding to a leading end of the non-fixed image in a sub scanning direction to start operating corresponds to a timing for the leading end of the non-fixed image to reach the fixing nip.

12. The image forming apparatus according to claim 10, wherein the processor sets the current application pattern to a first current application pattern of continuously applying current to the heat generator when the print medium is estimated to have a first heat capacity, and to a second current application pattern of intermittently applying current to the heat generator when the print medium is estimated to have a second heat capacity that is smaller than the first heat capacity.

13. The image forming apparatus according to claim 10, wherein the processor sets the current application pattern to a first current application pattern of applying current to the heat generator for a first period of time when the print medium is estimated to have a first heat capacity, and to a second current application pattern of applying current to the heat generator for a second period of time shorter than the first period of time when the print medium is estimated to have a second heat capacity that is smaller than the first heat capacity.

14. A method of controlling an image forming apparatus, the image forming apparatus including a fixing member and a pressing member forming a fixing nip therebetween, and a heat generator disposed to heat a print medium passing through the fixing nip via the fixing member, the method comprising:

controlling the heat generator to start heating at a timing when a non-fixed image portion formed on the print medium is expected to reach the fixing nip, based on image data of an image to be fixed, a conveyance speed of the print medium, and an estimated heat capacity of the print medium.

15. The method according to claim 14, wherein the heat generator is individually controllable with respect to a plurality of regions thereof in a main scanning direction, and the heat generator is controlled, such that a timing for one of the regions of the heat generator corresponding to a leading end of the non-fixed image in a sub scanning direction to start operating corresponds to a timing for the leading end of the non-fixed image to reach the fixing nip.

16. The method according to claim 14, wherein the heat generator is controlled to start heating at a first timing when the print medium is estimated to have a first heat capacity, and at a second timing earlier than the first timing when the print medium is estimated to have a second heat capacity that is greater than the first heat capacity.

17. The method according to claim 14, further comprising:

estimating heat capacity based on at least one of a basis weight, a ream weight, and a thickness of the print medium.

18. The method according to claim 14, further comprising:

estimating heat capacity based on a material of the print medium.

19. The method according to claim 14, wherein the heat generator is controlled to start heating at a first timing when the estimated heat capacity is smaller than a first threshold, and at a second timing earlier than the first timing when the estimated heat capacity is greater than the first threshold.

20. The method according to claim 14, further comprising:

controlling current applied to the heat generator according to a current application pattern that is set based on the estimated heat capacity.

* * * * *